United States Patent [19]

White

[11] 4,406,486

[45] Sep. 27, 1983

[54] LOCK MECHANISM

[76] Inventor: David R. White, 1129 Monroe S.E., Albuquerque, N. Mex. 87108

[21] Appl. No.: 267,173

[22] Filed: May 26, 1981

[51] Int. Cl.[3] ..... E05C 1/06

[52] U.S. Cl. ..... 292/144

[58] Field of Search ..... 292/144, 166, 201, 167, 292/168

[56] References Cited

U.S. PATENT DOCUMENTS

| | | | |
|---|---|---|---|
| 1,637,275 | 7/1927 | Peterson | 292/144 X |
| 2,815,796 | 12/1957 | Lobanoff | 292/144 X |
| 3,627,960 | 12/1971 | Grobek | 292/144 |

FOREIGN PATENT DOCUMENTS

| | | | |
|---|---|---|---|
| 903911 | 2/1954 | Fed. Rep. of Germany | 292/144 |

*Primary Examiner*—Richard E. Moore

*Attorney, Agent, or Firm*—Donald J. Singer; Thomas L. Kundert

[57] ABSTRACT

An electrically operated locking system for securing two heavy gate members together, and at least one of the gate members is moveable. The system includes a locking mechanism mounted on one gate member and a latch bolt fixed to the other gate member. The locking mechanism includes latch members that receive the latch bolt therebetween and a lock pin connected to an electrically actuated linkage that secures the latch bolt in the latch members. The locking system includes a mechanical lock-out feature, and it has the capability of being operated from a remote site.

2 Claims, 3 Drawing Figures

LOCK MECHANISM

STATEMENT OF GOVERNMENT INTEREST

The invention described herein may be manufactured and used by, or for, the Government for governmental purposes without the payment of any royalty thereon.

BACKGROUND OF THE INVENTION

The invention relates generally to locking mechanisms. More particularly, the invention relates to electrically operated locks adapted for use on heavy gate structure employed as vehicle gates for closing roads into security areas.

Large controlled areas, such as military installations, industrial plants, and the like typically utilize numerous gates for the entrance and egress of personnel and vehicles. Frequently, these gates are remotely controlled and have electrical lock mechanisms. The lock mechanisms are actuated by electrical signal, for example, transmitted from a control station situated some distance away. While electrically operated lock mechanisms can be used to great advantage by eliminating the need for a guard to be positioned at each gate, experience has shown that existing electrically operated lock mechanisms are unreliable due to frequent malfunction. During inspections, it has been found that the lock mechanisms fail to lock after a gate has been closed. Sometimes a gate which appears to be securely locked will unlock during a check. A brisk shaking of the gate causes the lock to open. If for any reason a gate lock mechanism malfunctions, it is usually necessary to post a guard until a technician repairs or replaces the lock mechanism.

The deficiencies of prior art commercially available electrical lock designs stem in large part from their complexity and need for frequent adjustment and maintenance. Accordingly, it is an object of the invention to provide an improved electrically operated lock mechanism which is simple in design but is highly reliable and inexpensive.

It is another object of the invention to provide a heavy duty electrically operated lock mechanism which is durable enough to secure heavy structures together.

These and other objects of the invention will become apparent from the detailed description and representative embodiment which follows.

SUMMARY OF THE INVENTION

The present invention is an electrically operated locking system for securing two heavy gate members together, and at least one of the gate members is movable. The system includes a locking mechanism mounted on one gate member and a latch bolt fixed to the other gate member. The locking mechanism includes latch members that receive the latch bolt there between and a lock pin connected to an electrically actuated linkage that secures the latch bolt in the latch members. The locking system includes a mechanical lockout feature, and it has the capability of being operated from a remote site.

DETAILED DESCRIPTION OF THE INVENTION

Figure 1:
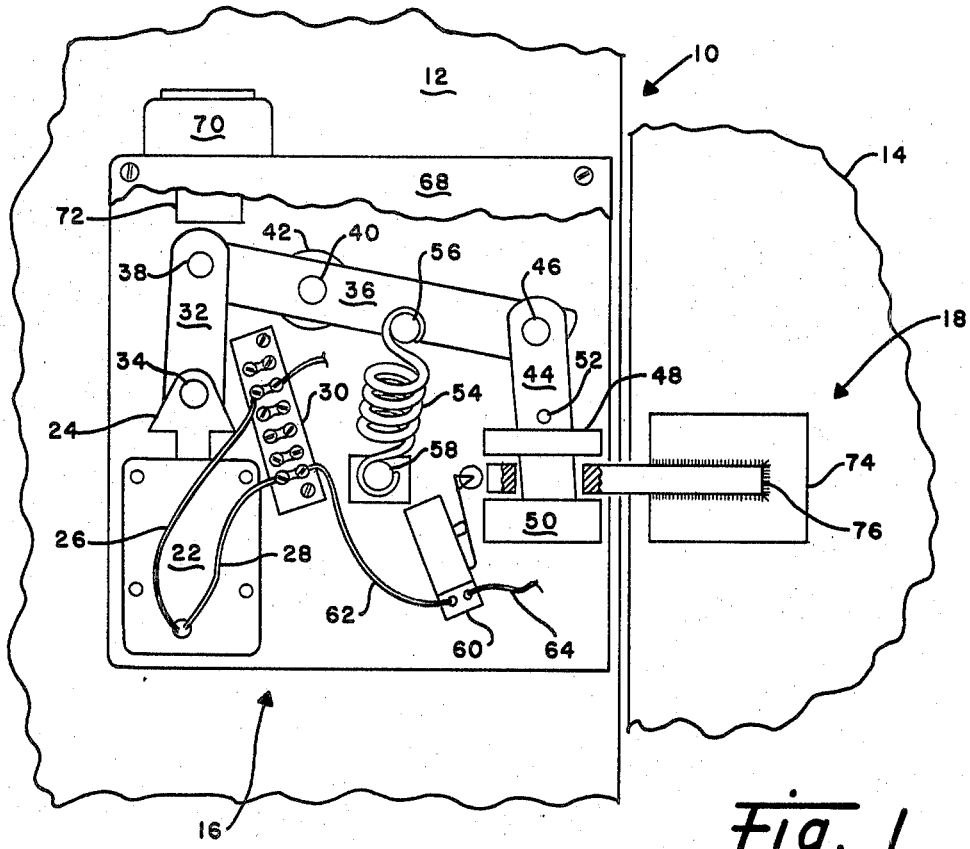
FIG. 1 is view of the locking system mounted on two gate members. The cover of the locking mechanism is broken away to show internal details of the mechanism.

FIG. 1 of the drawing shows a locking system 10 installed on two heavy gate members 12 and 14 that are shown in a closed position. Locking system 10 consists of a locking mechanism 16 mounted on gate member 12 and a latch assembly 18 mounted on gate member 14.

Figure 3:
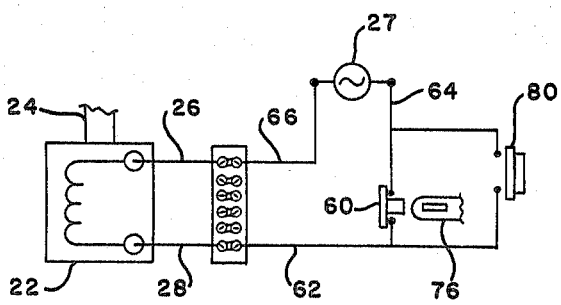
FIG. 3 is a diagram of a simplified circuit that could be employed with the locking mechanism.
Figure 2:
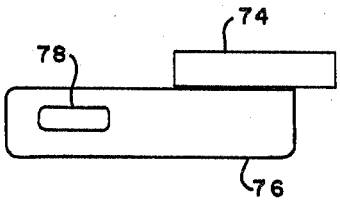
FIG. 2 is view of the latch bolt removed from the gate member on which it is mounted.

Locking mechanism 16 includes a base plate 20 that is suitably secured to gate member 12 by, for example, bolts or welding. A solenoid mechanism 22 having a plunger 24 is mounted to the base plate and connected to a suitable source of AC power 27, see FIG. 3, by wires 26 and 28. Wires 26 and 28 are connected to a terminal board 30 mounted on the base plate. Plunger 24 is pivotally connected to link 32 by pin 34. Link 32 is pivotally connected to link 36 by pin 38. Link 36 is pivotally mounted on base plate 20 by a pin 40 that extends from boss 42 attached to the base plate by welding or other suitable means. A latch pin 44 is pivotally connected to one end of link 36 by pin 46. A pair of spaced-apart latch members 48 and 50 are secured to the back plate by welding or other suitable means. The latch members are positioned such that latch pin 44 will pass through openings, not shown, therein. Latch pin 44 is provided with a stop 52 which prevents the latch pin from traveling too deep into latch members 48 and 50. A return spring 54 is connected between link 36 and base plate 20 to cause clockwise rotation of link 36 about pin 40. One end of spring 54 is connected to boss 56 fixed on link 36 and the other end of spring 54 is attached to boss 58 fastened to the backplate.

A microswitch 60 is mounted on the back plate adjacent latch members 48 and 50. The function of microswitch 60 is to interrupt the power to solenoid 22. Solenoid 22 is connected to the microswitch by wires 28 and 62. Another wire 64 leads from microswitch 60 to the source of AC power. The solenoid is connected to the source of AC power by the electrical lead 66.

The mechanism just described is covered by a cover plate 68, shown broken away. A mechanical lockout device 70 is suitably attached to the cover 68. Lock-out device 70 is a conventional device which is key operated. When operated, plunger 72 engages and pushes link 36 in a counterclockwise motion about pin 40 to pull latch pin 44 upwardly to an unlocked position. Lockout device 70 can be used anytime it is desired to immobilize the locking mechanism in an unlocked position, for example, when there is a power failure.

Latch assembly 18 consists of a plate 74 attached to gate member 14 by bolts, welding or other suitable means. A latch bolt 76 is welded or otherwise suitably attached to plate 74. Latch bolt 76 has an aperture 78 formed in one end thereof. The latch assembly is positioned on gate 14 such that the aperture 78 aligns with similar openings in latch members 48 and 50 when the gates are in a closed position.

In operation, assuming the gates are closed in the position shown in FIG. 1 and it is desired to open the gates. The operator in charge of opening the gates will press a switch 80, see FIG. 3, which would normally be located some distance from the gates. Actuating switch 80 applies power to solenoid 22 causing plunger 24 to be pulled downwardly for its full travel. Full travel of plunger 24 for the embodiment shown is ½ inch. Movement of plunger 24 causes link 32 to move which in turn rotates link 36 about pin 40. Rotation of link 36 lifts latch pin 44 upwardly for a travel of two inches and also extends spring 54. The lifting of latch pin 44 frees latch bolt 76 so that gate 14 can be moved to an open position by an electric motor or other suitable means (not shown). Microswitch 60 is a normally closed switch so movement of latch bolt 76 to an unlocked position allows switch 60 to close and maintain electrical power to solenoid 22. Solenoid 22 will hold the locking mechanism in an unlocked position as long as power is applied thereto. Thus, as soon as the gate 14 moves with respect to gate 12, the operator can release switch 80 and the locking mechanism will remain in an unlocked position. When gate member 14 is returned to a closed position, latch bolt 76 engages the spring arm on microswitch 60 to disconnect solenoid 22 from electrical power. This inactivates the solenoid and allows spring 54 to cause rotation of link 36 in a clockwise direction and return latch pin 44 to a locked position.

This completes the detailed description of the invention. Only a very simplified circuit has been shown in FIG. 3, and it should be understood that various circuit arrangements can be used to accommodate the particular type of gate opening mechanism in use.

What is claimed is:

1. A locking system for securing two gate members together in a closed position that includes a locking mechanism mounted on one gate member and a latch bolt means mounted on the other gate member in a position to be engaged by said locking mechanism and lock the two gate members together when said two gate members are in a closed position, said locking mechanism comprising:

a base plate mounted to the one gate member for supporting components of said locking mechanism;

a pair of spaced-apart latch members mounted on said base plate in a position to receive said latch bolt means therebetween, said pair of spaced-apart latch members and said latch bolt means each having openings therein which are aligned when the gate members are in a closed position;

a linkage means pivotally mounted on said base plate;

a latch pin pivotally mounted to one end of said linkage means and positioned such that in an unlocked position of said locking mechanism one end of said latch pin enters only the opening in the upper one of said pair of spaced-apart latch members, and in a locked position of the locking mechanism the latch pin passes through the openings in the spaced-apart latch members and the latch bolt;

spring means connected between said linkage means and said base plate for normally biasing said linkage means and latch pin to a locking position;

solenoid means mounted on said base plate, said solenoid being electrically connected to a source of electrical power and mechanically connected to the other end of said linkage means for overriding the action of said spring means and moving the linkage means and thelatch pin to an unlocked position when actuated;

switch means electrically connected between said solenoid and power source and mounted on said back plate in a position to be actuated to an open circuit condition by said latch bolt means when the latch bolt means is in a locked position;

said linkage means including a first link pivotally mounted to the base plate and pivotally attached at one end thereof to the latch bolt means, a second link pivotally attached at one end to the other end of said first link and the other end of said second link is pivotally attached to said solenoid means;

a cover means removably mounted to said base plate for covering said locking mechanism, and a mechanical lockout means mounted on said cover means in a position for engaging said linkage means and holding it is an unlocked position, thereby providing a method of disabling the locking mechanism in case of a power failure.

2. The locking system recited in claim 1 wherein said lockout means engages said linkage means at the point where said first and second links are pivotally connected.

* * * * *